United States Patent [19]

Skovdal et al.

[11] Patent Number: 4,625,738

[45] Date of Patent: Dec. 2, 1986

[54] HEATED BRISTLE CURLING BRUSH

[75] Inventors: Jorgen Skovdal, Trumbull; Loretta D. Goeller, Rowayton, both of Conn.

[73] Assignee: Clairol Incorporated, New York, N.Y.

[21] Appl. No.: 659,108

[22] Filed: Oct. 5, 1984

Related U.S. Application Data

[63] Continuation-in-part of Ser. No. 597,950, Apr. 9, 1984.

[51] Int. Cl.[4] ..... A45D 1/00

[52] U.S. Cl. ..... 132/9; 132/37 R; 132/33 R; 219/222

[58] Field of Search ..... 122/9, 37 R, 33 R; 219/370, 222, 225

[56] References Cited

U.S. PATENT DOCUMENTS

| | | | |
|---|---|---|---|
| 3,459,199 | 8/1969 | Connell | 132/11 A |
| 3,563,251 | 4/1969 | Jorgensen | 132/33 R |
| 4,196,343 | 4/1980 | Han | 219/370 |
| 4,473,086 | 9/1984 | Thaler | 132/37 R |
| 4,496,825 | 1/1985 | Andis | 132/37 R |

FOREIGN PATENT DOCUMENTS

| | | |
|---|---|---|
| 1103156 | 2/1968 | United Kingdom . |
| 1558737 | 1/1980 | United Kingdom . |

*Primary Examiner*—Gregory E. McNeill
*Attorney, Agent, or Firm*—G. Warzecha; J. J. Balser

[57] ABSTRACT

The present invention relates to a heated curling brush with bristles which are relatively tangle-free in use. The heated curling brush of the present invention is provided with bristles which are capable of transmitting heat to the hair while at the same time avoiding the undesirable tangling resulting from use of prior art brushes.

9 Claims, 14 Drawing Figures

HEATED BRISTLE CURLING BRUSH

This is a continuation-in-part of application Ser. No. 597,950, filed Apr. 9, 1984.

FIELD OF THE INVENTION

The present invention relates to a heated bristle brush for styling hair without tangling the hair or irritating the scalp.

BACKGROUND OF THE INVENTION

There have been numerous attempts in the prior art to provide a means for effectively and easily brushing and curling hair with a heated brush. Typical of the prior art attempts to provide suitable brush means are U.S. Pat. Nos. 675,527; 1,258,375; 1,393,635, 1,436,957; 4,030,158; 4,314,137; and 4,368,376.

These devices fall into two classes: first, brushes used solely for brushing hair typified by U.S. Pat. Nos. 675,527; 1,258,375; 1,393,635; 1,436,957; and 4,030,158 which are used primarily for brushing hair in straight strokes and to provide body and to assist in drying of hair when used with drying devices commonly known as blow dryers; and second, heated curling irons or brushes used to style the hair and impart a wave thereto typified by U.S. Pat. Nos. 4,314,137 and 4,368,376.

Although brushes in the former group are generally satisfactory for conventional brushing, they are unsuitable for curling or waving hair. As to the latter group, it has been found that while generally they perform the function for which intended, i.e., to curl or wave the hair, there is a tendency for the hair to tangle in the curling brush or to be snarled by use of the brush. Furthermore, brushes of either type, can, depending on their construction irritate or scratch the scalp when used because of the use of generally pin-shaped bristles.

In addition, where metal bristles are employed, user contact with the heated bristles can result in painful contact, particularly when the user grips the ends of the hair to keep the ends from slipping off the curler brush when rotation of the hair on the curler is started.

Another problem that arises with the use of prior art brushes is that tangling occurs from twisting the brush while winding the tresses. Bristle curling brushes designed according to prior art techniques frequently cause tangling after several rotations of hair around the brush, as the pins or bristles become caught in the underlying hair. Such brushes generally are constructed of metal pins or plastic teeth mounted in a support structure which terminates in a handle. Tangling of the hair can occur in brushes having either metal pins or plastic teeth. However, the plastic teeth of some prior art brushes do not permit more than one layer of hair to get below the tips of the teeth and in such brushes, the tangling problem is less severe. In brushes having metal bristles, on the other hand, the shape, flexure and friction coefficient of the pins does permit layers of hair to slide down the pins and it has been found that severe tangling of the hair results.

In addition to the aforementioned prior art devices employed to brush or curl the hair, there is yet another category of devices commonly employed in hair curling. These are generally referred to as hair curlers or winders and are externally heated, cylindrical devices around which several layers of hair are wrapped after the device has been preheated to aid in curling. Typical of these devices are U.S. Pat. Nos. 3,566,887 and 3,706,315. Although these devices are suitable for hair curling, they are unsuitable for use in brushing hair. Furthermore, because of their design, they are restricted as to the number of layers of hair, generally one or two, which can be wound through the tabs or spades of the winder.

The size and spacing of the heated bristles should preferably be such as to prevent the users' fingers from being able to touch the barrel. Users generally do not intentionally touch the barrel. Instead, they place their fingers on top of the hair ends when starting rotation of the rush to keep the ends from slipping off. In placing their fingers in such a manner, the users make contact with the bristles. With plastic bristles this is not as much of a problem since they are cooler and do not conduct heat as readily. However, with devices having bristles of heat-conductive composition, painful contact with the bristles adjacent to the heated housing can occur. This problem is substantially reduced by the instant invention which minimizes the need for the user to have to grip the ends of the hair in order to start rotation of the brush. The gripping of the hair ends during start of rotation may be accomplished by providing a barrel surface having dimples, a roughened surface, a flocked surface or a rubber surface.

The tips of the bristles used in the heated curling brushes of the present invention which are in contact with the scalp should be relatively smooth to avoid scalp irritation during use. The tips may be coated or rounded to provide the desired smooth surface. Coating the tips with a thin plastic thermal insulating material also enhances comfort and safety by slightly decreasing tip temperature.

There is no known prior art disclosing a bristle curling brush showing use of bristles which are relatively tangle-free and able to be heated to enable application of heat throughout the layers in a hair tress. Moreover, while heated bristle curling brushes are known such as that shown in U.S. Pat. No. 4,314,137, there is no suggestion in such prior art devices of how to efficiently heat loop or arch-shaped bristles. It has been found that the use of arch-shaped bristles, each end of which is in thermal contact with a heated core, enables the bristle tips to reach a satisfactory operating temperature with the use of a lower temperature heated core than is possible with straight, pin-shaped bristles. It will be understood that, while the term "arch-shaped" is generally used herein, the shape of the bristles may be other than an actual arch. The bristles may be star-shaped, substantially round or rectangular, solid or hollow, etc. The only requirement being that the base of each bristle subtend an arcuate length of more than about 20° on the barrel.

SUMMARY OF THE INVENTION

The present invention relates to a heated bristle curling brush comprising a handle, a barrel extending from the handle, including an interiorly located heating element, and having a longitudinal axis and an outer peripheral surface radially spaced from the longitudinal axis, which outer surface is provided with a plurality of angularly spaced rows of longitudinally spaced and radially outwardly extending arch-shaped bristles, the base of each occupying an arc of about 20° C. to about 110° on the circumference of the barrel and the height of the bristles being at least one half of the diameter of the barrel, but not less than about 0.375 inch. Preferably the diameter of the barrel is 0.375 inch to 2.0 inches, and more preferably 0.5 inch to 1.0 inches, wherein the height of the bristles is at least one half the diameter of the barrel, but not less than about 0.375 inch. The distance between adjacent parallel rows of bristles spaced longitudinally along the barrel is sufficient to permit the brush to move through the hair, preferably between about 0.125 inch to 0.75 inch and more preferably about 0.25 inch.

The unique design of the bristles used in the brushes of the present invention does not cause tangling. The reasons for this depend on the type of tangling which could occur. A small bristle, such as a straight pin, can pierce an already tangled clump of hair, while the bristles of the present invention will have the tangle fall on one side of the other. A second way that tangling can occur is from twisting the brush while winding the tress. If the tress is lying taut on the barrel, changing the angle will not cause tangling, but twisting the barrel when some of the hair is looser than the rest and the hair is entwined, can cause entanglement. The hair, when not taut, can be interwoven between the pins when being wound-up. Removal, after the hair has been pulled taut so that it lays flat on the barrel, is not as easy because it is nearly impossible to reverse the random manner in which the hair is interwoven around the pins.

Tangling does not occur with the curling brushes of the present invention because the unique bristle configuration requires the path into the underlying hair and the path out to be the same so hair no longer becomes wound around the bristles. This shape also permits the hair to slide down the pins for better heating of all the layers wrapped around the brush.

The various embodiments of the present invention avoid the aforementioned tangling problems. With each bristle having a height of at least about one half inch and having a base being a portion of an arc of about 20° to about 110°, the hair cannot readily be interwoven between the rows as it is being rolled on the brush or looped around one bristle and pulled taut. It is also possible to weave hair from one side of the row of bristles, but weaving the hair over three rows and then looping it back can no longer occur since the loops separate the hair like comb teeth as they enter the hair. The bristles need not be in symmetrical configuration in order to provide the desired results of the present invention.

If the preferred embodiment employing metal bristles in arch configuration having semi-rounded distal tips, the bristles are spaced so that they occupy an arc of about 20° to about 50° spaced around the circumference of the barrel, the rows of such bristles spaced longitudinally along the barrel at about 0.25 inch intervals to prevent the user from inserting a finger between such bristles and prevent contact with the heated outer barrel of the brush.

In a preferred embodiment, the bristles are arcs formed of metal with each end or base of each bristle in thermal contact with the barrel. Both ends of the bristles make contact with the inner core of the barrel so the bristles are heated by the heating means within the core. The bristles may radially extend through slots in a housing or sheath covering of the inner core. Although heating may be provided by commonly used positive temperature coefficient or electric resistance heater units, it is well recognized that alternate forms of heating such as butane catalytic heaters or forced hot air may be employed.

The bristles of the present invention permit the transfer of heat from a relatively hot barrel, i.e. 120° to 150° C. to the adjacent hair in contact with the bristles while simultaneously providing a bristle tip temperature of about 40° to 70° C. and preferably 60° to 70° C. The structure of the present invention enhances the thermal contact between the bristles and the heated inner core and enables the efficient transfer of heat from the core to the bristle tips.

The bristles of the present invention are formed in bristle members which are then assembled with the core. A bristle member may comprise one or more bristles formed from wire of a predetermined diameter or stamped from sheet-metal of predetermined thickness.

DESCRIPTION OF THE PREFERRED EMBODIMENT

Figure 2:
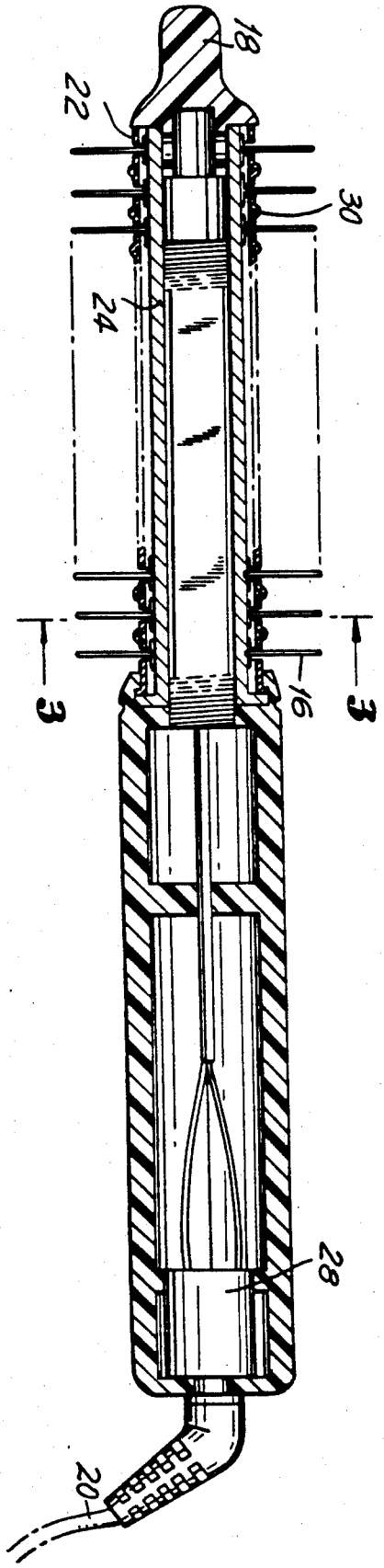
FIG. 2 is an axial sectional view of the heated bristle brush shown in FIG. 1.
Figure 1:
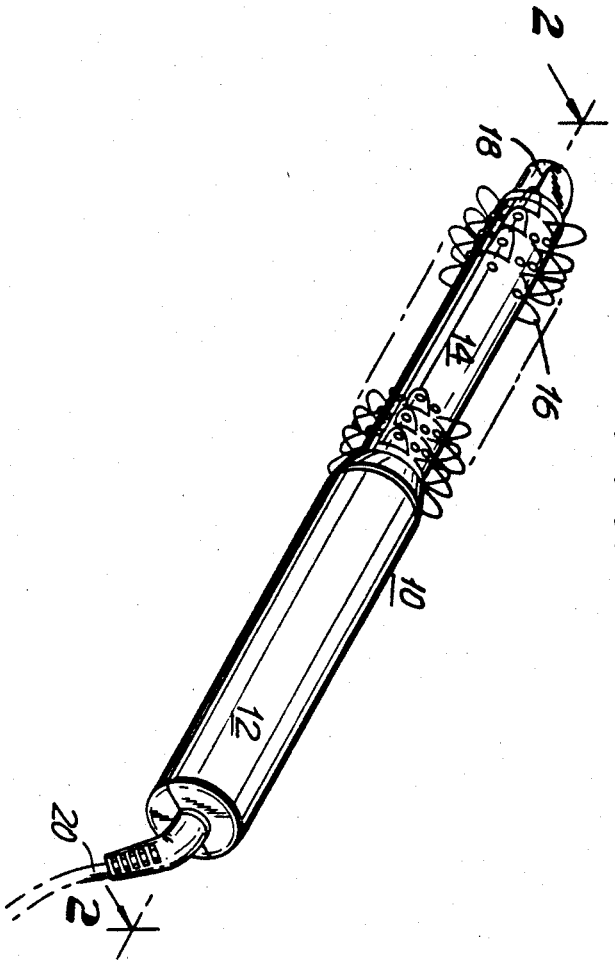
FIG. 1 is a perspective view of a preferred embodiment of the heated bristle brush of the present invention.

As shown in the drawings, the heated bristle brush of the present invention 10 comprises a handle 12, a barrel 14, bristles 16 radially spaced on said barrel 14, an end cap 18 and line cord 20. Barrel 14 is comprised of a barrel housing or covering 22 which has located therewithin inner core 24 and heating element 26 connected to line cord 20 in handle 12 and terminal 28. Optionally displaced from the surface of barrel housing 22 are nubs or dimples 30. Although barrel 14 as shown has a barrel housing 22 and an inner core 24, it is also contemplated that barrel housing 22 and inner core 24 could comprise an unitary component.

Figure 3:
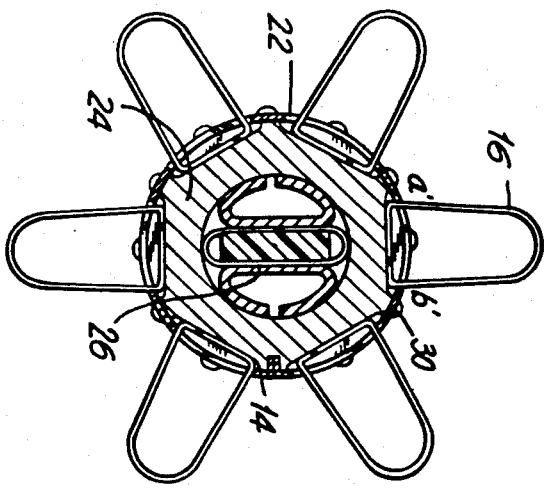
FIG. 3 is a cross-sectional view of the heated bristle brush shown in FIG. 1 taken along line 3—3.

The bristles 16 are preferably constructed of metal to facilitate heat transfer from heating element 26 through inner core 24 and barrel housing 22 in communication therewith and thence to bristles 16. Alternatively, the bristles may be constructed of any substantially rigid, thermo-conductive plastic material. The metal bristles may be constructed of a highly heated conductive metal such as copper, aluminum, or steel; stainless steel being the preferred metal for reasons of economy and appearance. The bristles will be constructed from wire or metal stampings to provide maximum heat transfer and low weight while at the same time substantially eliminating the tangling problems encountered by use of prior art metal pin bristle brushes. As will be noted in FIG. 3, bristles 16 may be formed individually (in "loops") arranged radially about core 24 and aligned in longitudinal rows 40. Bristles 16 are fastened to and maintained in contact with inner core 24 by barrel housing 22. The base of each bristle 16 is formed flat to provide a good thermally conductive contact with the surface of core 24 which is provided with a plurality of longitudinal flat grooves 42 for facilitating the thermal contact. Barrel housing 22 is a tubular sheath or cover (made of, for example, stainless steel) provided with slots through which bristles 16 project. Alternatively, bristles 16 may be fastened by any other commonly known fastening means which will permit bristles 16 to contact inner core 24 and be heated thereby. Typically, the barrel could be provided with longitudinal grooves which would permit insertion of the metal loop bristles or replacement thereof with other combs.

Numerous alternative designs are possible for producing a heated bristle curling brush having arch-shaped bristles in efficient thermal contact with the heated inner core. Several such configurations are shown in FIGS. 4–9.

Figure 4:
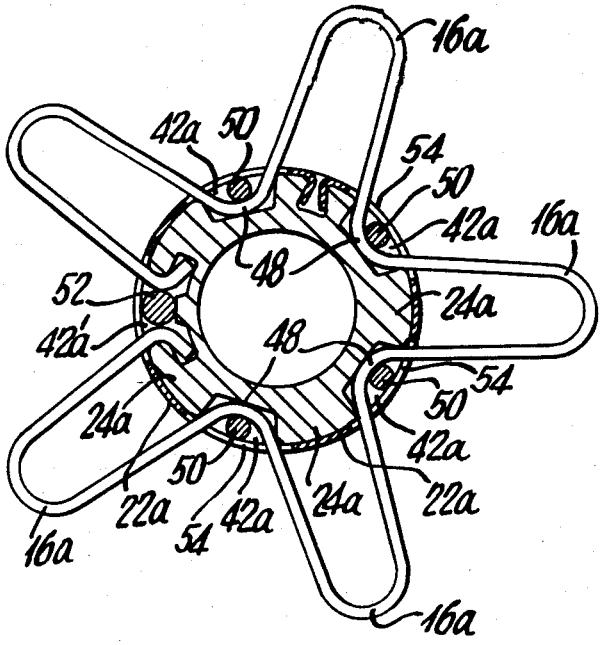
FIG. 4 is a cross-sectional view of a first alternative construction of arch-shaped bristles showing a planar bristle member having a plurality of radially extending bristles formed therein.

FIG. 4 is a cross-sectional end view of a heated bristle curling brush showing a planar wire bristle member 46 formed into a plurality of arch-shaped bristles 16*a* radially arranged about inner core 24*a*. It will be noted that a plurality of bristle members 46 will be longitudinally spaced along a barrel to provide rows of bristles 16*a* and that cores 24 and 24*a* differ in cross-section in order to accommodate the different shapes of the bases of the bristles with which each core is designed to fit. (The inner heating element of core 24*a* is identical to that of core 24 in FIG. 3 and is omitted for clarity.) Core 24*a* is provided with longitudinal grooves 42*a* for receiving the bases 48 between adjacent bristles 16*a*. Grooves 42*a* may be shaped as shown or may be complementarily shaped to follow the contour of bases 48 in order to enhance thermal conductivity between the core 24*a* and bristles 16*a*. Groove 42*a'* is adapted to receive the ends of bristle member 46. Longitudinal locking pins 50 and 52 are provided to cooperate with barrel housing 22*a* to retain bristle members 46 on the barrel. Housing 22*a* is provided with a plurality of sets of radially arranged arcuate slots 54, each set for receiving one planar bristle member 46. In constructing the structure shown in FIG. 4 the housing 22*a* is first crimped on the core 24*a* and then the bristle members 46 are pressed into corresponding sets of slots 54 and locked therein by inserting locking pins 50 an 52 from an end of core 24*a*.

Figure 5B:
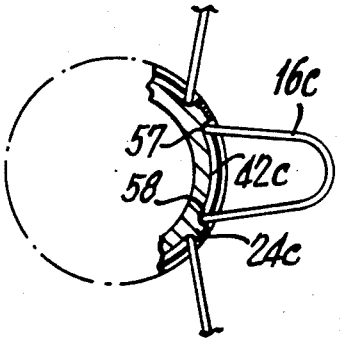
FIGS. 5*a* and 5*b* and 6*a* and 6*b*, show diagrammatic plan views and corresponding end views of a portion of a barrel with a second and third alternative construction of arch-shaped bristles showing wire rod longitudinal bristle members having a plurality of bristles formed therein.
Figure 5A:
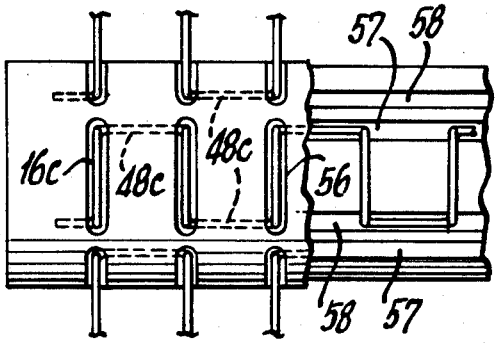
Figure 6B:
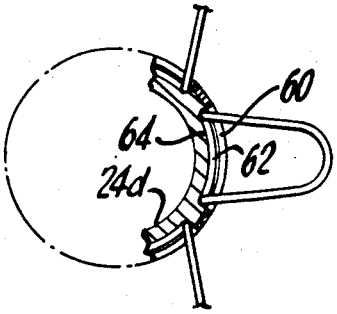
Figure 6A:
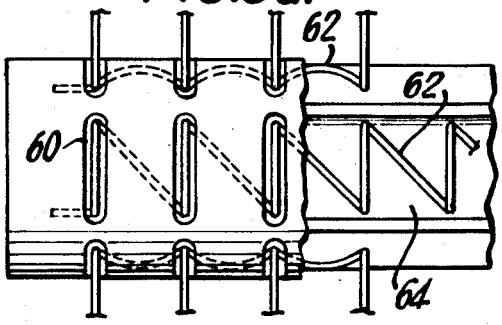
Figure 7B:
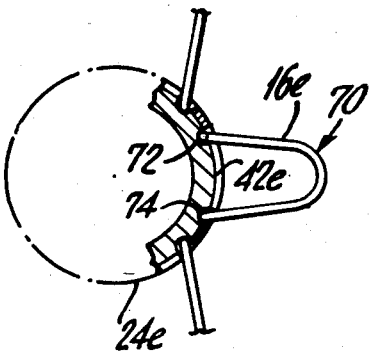
FIGS. 7*a* and 7*b*, 8*a* and 8*b*, and 9*a* and 9*b* show diagrammatic plan and corresponding end views of a portion of a barrel with a fourth, fifth and sixth alternative construction of archshaped bristles showing stamped metal longitudinal bristle members having a plurality of bristles formed therein.
Figure 7A:
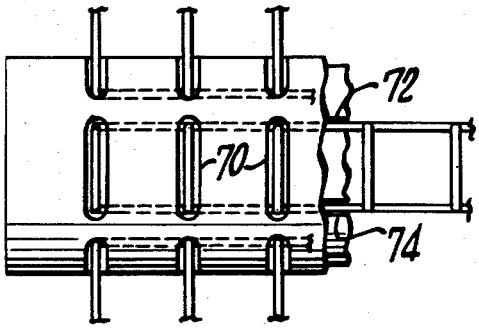
Figure 8B:
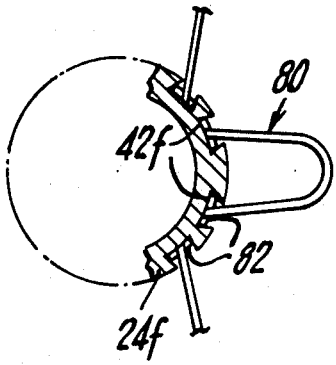
Figure 8A:
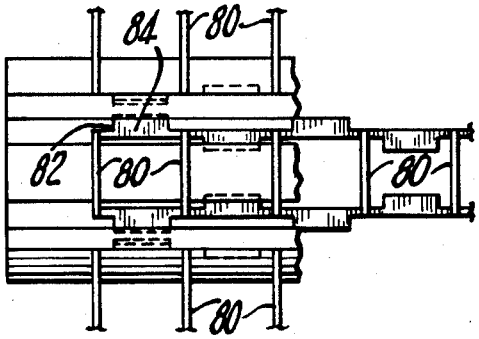
Figure 9B:
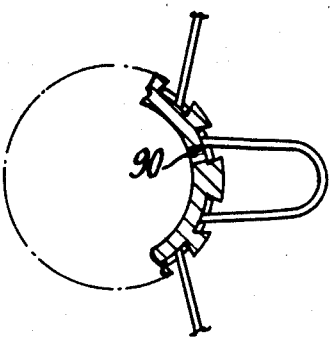
Figure 9A:
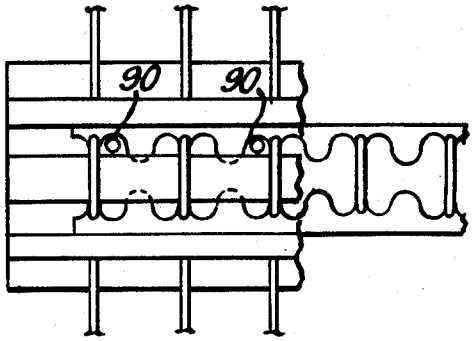

Referring now to FIGS. 5*a* and 5*b*, and 6*a* and 6*b*, there are shown alternative embodiments of arch-shaped bristles. FIG. 5*a* shows a plurality of wires bent as shown into longitudinal bristle members 56, each formed into a plurality of parallel, longitudinally spaced bristles 16*c*. The longitudinal base-portions 48*c* are designed to fit into grooves 57 and 58. Bristles 16*c* extend radially through slots in barrel housing 22*c* as in the aforementioned embodiments. A groove 42*c* may be formed between grooves 57 and 58. Groove 42*c* may be amended as shown or may be flat in order to decrease the mass and weight of inner core 24*c*. FIG. 6 shows a similar longitudinal bristle member 60 wherein bristles are connected by diagonal base portions 62 which are also curved to conform to the contour of longitudinal grooves 64 in core 24*d*.

FIGS. 7*a* and 7*b*, 8*a* and 8*b*, and 9*a* and 9*b* show alternative longitudinal bristle member structures utilizing thin sheetmetal as opposed to wire. The base portions of each bristle member are flat and curved to conform to the core contour at the surface of contact. In FIG. 7 bristle members 70 are provided with two base portions 72 and 74 between each bristle 16*e*. Core 24*e* is provided with complementarily shaped grooves 42*e* to receive the base portions. Groove 43*e* is shown as being a set of parallel grooves, each for receiving one of the base portions 72 or 74. Alternatively a single wider groove could be used to receive base portions 72 and 74 at the sides of the groove. In FIG. 8, core 24*f* is provided with groove 42*f* and no covering is used so that longitudinal bristle members 80 may be inserted into corresponding grooves or interchanged with other members such as differently shaped bristles, combs, etc. Locking tabs 82 are stamped into such base portions 84 to retain each bristle member 80 on the core 24*f* without the need for a covering housing. FIG. 9 shows a structure similar to FIG. 8 but the locking tabs are shaped differently to allow steam apertures 90 to be uncovered thereby enabling use of this invention with steam curling irons.

It will be apparent to those skilled in the art that all of the foregoing embodiments may be utilized with a rotatable type curling iron or brush wherein the bristles are attached to an outer barrel which is rotatable relative to the handle.

The foregoing is a description of the preferred embodiment of the invention, and variations may be made without departing from the spirit or the scope of the invention, as defined by the appended claims.

What is claimed is:

1. In an internally heated hair curling brush comprising a handle, a barrel extending from said handle, said barrel having a longitudinal axis and an outer surface radially spaced from said longitudinal axis, said surface provided with a plurality of grooves, the improvement comprising:

a plurality of bristle members in thermal contact with said barrel, each bristle member formed into a plurality of generally arch-shaped heat conducting bristles each of which, when said bristle members are in operative association with said barrel, extend radially from said axis along a predetermined acruate length and are aligned in a plane substantially perpendicular to said axis, a portion of each bristle member near the base of each bristle being shaped to generally mate with a corresponding one of said grooves, said aligned bristles having a predetermined arcuate gap between adjacent ones of said aligned bristles;

means for retaining said bristle members in thermal contact with said housing and for maintaining said radially extending orientation of said bristles.

2. An apparatus according to claim 1 wherein each bristle member comprises a longitudinally extending structure having a plurality of longitudinally space arch-shaped bristles.

3. An apparatus according to claim 2 wherein the bristles of a bristle member are parallel to each other.

4. An apparatus according to claim 1 wherein each bristle member comprises a planar structure having a plurality of arcuately spaced, radially extending arch-shaped bristles.

5. An apparatus according to claim 1 wherein each said bristle member comprises a wire shaped in a generally star-shaped planar form and is oriented perpendicular to said axis, said star-shaped bristle members being longitudinally spaced along said barrel, said grooves being longitudinal and wherein said retaining and maintaining means comprises:

(a) an outer sheath connected to said outer surface, said sheath having a plurality of sets of arcuate slots, each set for receiving therethrough one of said bristle members and (b) a plurality of longitudinal locking pins, each locking pin for extending longitudinally within selected ones of said longitudinal grooves for retaining a base portion of each of said bristle members in thermal contact with said surface in said selected longitudinal groove while enabling a substantial portion of adjacent arch-shaped bristles to extend radially through corresponding ones of said arcuate slots.

6. An apparatus according to claim 1 wherein each of said bristle members further comprises:

(a) a plurality of arch-shaped bristles longitudinally spaced along said member;

(b) a first base portion integrally formed with one end of each of said bristles;

(c) a second base portion integrally formed with the other end of each of said bristles, said first and second base portions generally extending parallel to each other.

7. An apparatus according to claim 6 wherein each of said base portions is a surface shaped complementarily to said outer surface within selected ones of said grooves.

8. An apparatus according to claim 7 wherein said grooves subtend a relatively small arcuate distance at a first predetermined radial distance from said axis and a relatively larger arcuate distance at a second predetermined radial distance smaller than said first predetermined radial distance, said base portion surfaces being thereby radially retained within corresponding ones of said grooves.

9. An apparatus according to claim 1 wherein said curling brush is further provided with steam generating means and said barrel has steam apertures and wherein each of said bristle members is provided with apertures which, in operation enable steam to pass from said steam aperture therethrough.

* * * * *